US012320230B2

(12) United States Patent
Yerubandi et al.

(10) Patent No.: US 12,320,230 B2
(45) Date of Patent: Jun. 3, 2025

(54) DESIGNING FLUIDS TO REDUCE CHANNELING AT AN INTERFACE

(71) Applicant: Halliburton Energy Services, Inc., Houston, TX (US)

(72) Inventors: K V V N Krishna Babu Yerubandi, Houston, TX (US); Anoop Sheshrao Jogdand, Pune (IN); John Paul Bir Singh, Kingwood, TX (US); Siva Rama Krishna Jandhyala, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 606 days.

(21) Appl. No.: 17/539,739

(22) Filed: Dec. 1, 2021

(65) Prior Publication Data

US 2023/0167731 A1 Jun. 1, 2023

(51) Int. Cl.
*E21B 33/14* (2006.01)

(52) U.S. Cl.
CPC ..... *E21B 33/14* (2013.01)

(58) Field of Classification Search
CPC ..... E21B 33/14; E21B 43/30; G01N 30/28; G01N 30/26; G01N 30/34; G01N 30/38; G01N 30/383
See application file for complete search history.

(56) References Cited

U.S. PATENT DOCUMENTS

2021/0108472 A1* 4/2021 Lopes Pereira ..... E21B 47/00
2021/0131234 A1 5/2021 Lopes Pereira et al.

OTHER PUBLICATIONS

Tehrani, Ahmadi, Ferguson, John, and S. H. Bittleston. "Laminar Displacement in Annuli: A Combined Experimental and Theoretical Study." Paper presented at the SPE Annual Technical Conference and Exhibition, Washington, D.C., Oct. 1992. (Year: 1992).*
Griffith, J. E., Nix, D. Q., and G. A. Boe. "Reverse Circulation of Cement on Primary Jobs Increases Cement Column Height Across Weak Formations." Paper presented at the SPE Production Operations Symposium, Oklahoma City, Oklahoma, Mar. 1993. (Year: 1993).*
Ali Etrati, Kamran Alba, Ian A. Frigaard; Two-layer displacement flow of miscible fluids with viscosity ratio: Experiments . Physics of Fluids May 1, 2018; 30 (5): 052103. (Year: 2018).*
"Definition of Produce" Merriam-Webster, Apr. 22, 2024, www.merriam-webster.com/dictionary/produce. (Year: 2024).*
Pelipenko, S.; Frigaard, I. A. (2004). Visco-plastic fluid displacements in near-vertical narrow eccentric annuli: prediction of travelling-wave solutions and interfacial instability. Journal of Fluid Mechanics, 520(), 343-377.

(Continued)

*Primary Examiner* — Son T Le
*Assistant Examiner* — Brian Butler Geiss
(74) *Attorney, Agent, or Firm* — Thomas Rooney; C. Tumey Law Group PLLC

(57) ABSTRACT

Techniques of the present disclosure relate to designing a fluid. A method comprises receiving at least one known parameter for a fluid design; receiving at least one constraint for the fluid design; estimating at least one unknown parameter for the fluid design; calculating displacement efficiency of the fluid design based on the at least one known parameter and at least one estimated parameter; and producing a designed fluid based on the displacement efficiency.

19 Claims, 7 Drawing Sheets

(56) References Cited

OTHER PUBLICATIONS

Frigaard, I.A.; Pelipenko, S. (). [Society of Petroleum Engineers SPE Latin American and Caribbean Petroleum Engineering Conference—Port-of-Spain, Trinidad and Tobago (Apr. 27, 2003)] SPE Latin American and Caribbean Petroleum Engineering Conference—Effective and Ineffective Strategies for Mud Removal and Cement Slurry Design.

Brady, S.D.; Drecq, P.P.; Baker, K.C.; Guillot, D.J. (). [Society of Petroleum Engineers SPE/IADC Drilling Conference—New Orleans, Louisiana (Feb. 18, 1992)] SPE/IADC Drilling Conference—Recent Technological Advances Help Solve Cement Placement Problems in the Gulf of Mexico.

International Search Report for International application No. PCT/US2022/041462 received Dec. 8, 2022.

Bu, Yuhuan et al., Determination of Optimal Density Difference for Improving Cement Displacement Efficiency in Deviated Wells, Journal of Natural Gas Science and Engineering, 2016, pp. 119-128.

Shadravan, Arash et al., Rheological Hierarchy Optimization Improves Fluid Displacement and Well Integrity, 3 Worldwide Case Studies, In: SPE Annual Technical Conference and Exhibition, Society of Petroleum Engineers, 2016, pp. 1-16.

Nguyen, D. et al., A Computational Algorithm for Calculating Displacement Efficiency in Horizontal Annuli—Eccentric Case, Chemical Engineering Communications, 2002, pp. 1-16.

Sun, Jinfei et al., Numerical Modeling of Motion of Displacement Interface in Eccentric Annulus During Primary Cementing, Energy Science & Engineering, 2020, pp. 1-14, inner pp. 1579-1591.

* cited by examiner

DESIGNING FLUIDS TO REDUCE CHANNELING AT AN INTERFACE

BACKGROUND

During wellbore operations, interface dynamics between two fluids may be primarily influenced by density differences between them. When heavier fluids are disposed below lighter fluids in a fluid column such as in a 'bottom-heavy' configuration, the density differences may reduce fluid channeling. However, when the heavier fluids are disposed above lighter fluids such as in a 'top heavy' configuration, the density differences may cause the fluid channeling.

The top-heavy configuration may occur during reverse cementing operations where a cement slurry may be pumped directly from the surface into annular space rather than being pumped down the casing string, such as in conventional/forward cementing operations. For example, an inadequate cement flow rate during the reverse cementing may cause heavy fluids to be positioned above lighter fluids, resulting in intermixing and maldistribution of the fluids such as the fluid channeling.

BRIEF DESCRIPTION OF THE DRAWINGS

These drawings illustrate certain aspects of some of the embodiments of the present method and should not be used to limit or define the method.

DETAILED DESCRIPTION

Techniques of the present disclosure generally relate to designing a fluid that reduces channeling at a fluid interface which may result in optimal displacement of another fluid. In some examples, friction gradients may be used to prevent fluid channeling at the fluid interface, during reverse cementing operations.

Figure 1C:
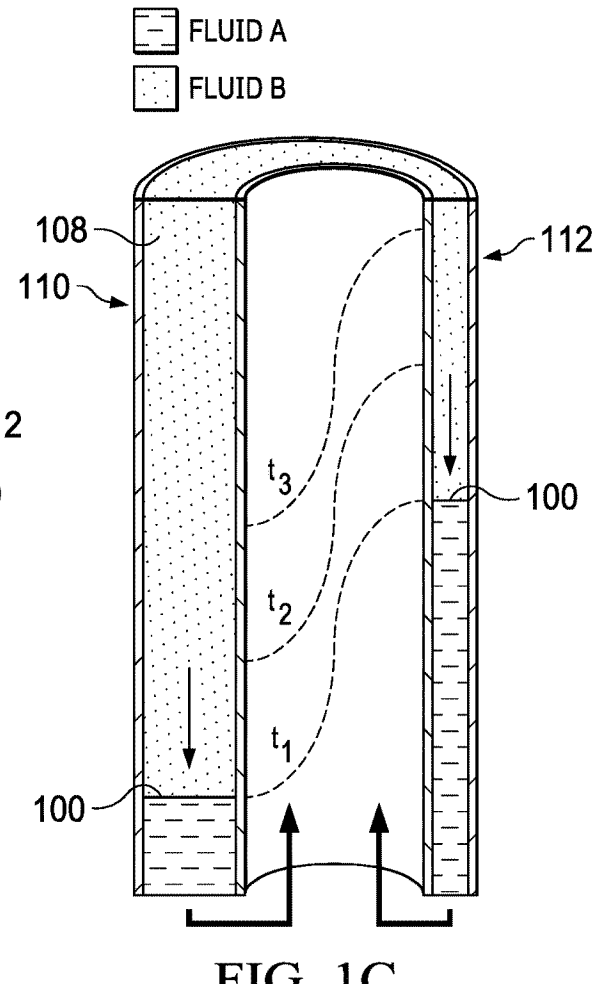
FIGS. 1A-1C illustrate fluid interfaces in a downhole environment, in accordance with examples of the present disclosure
Figure 1B:
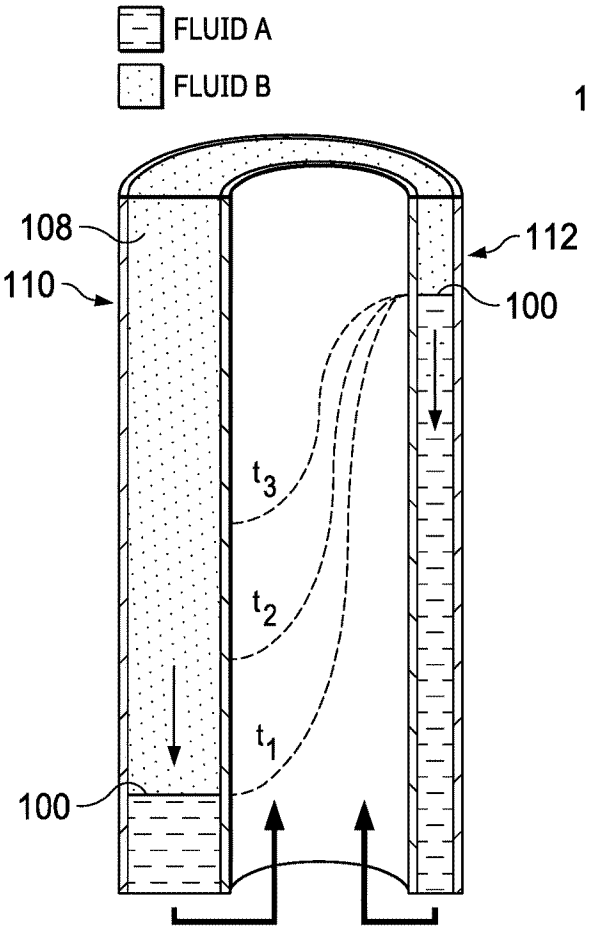
Figure 1A:
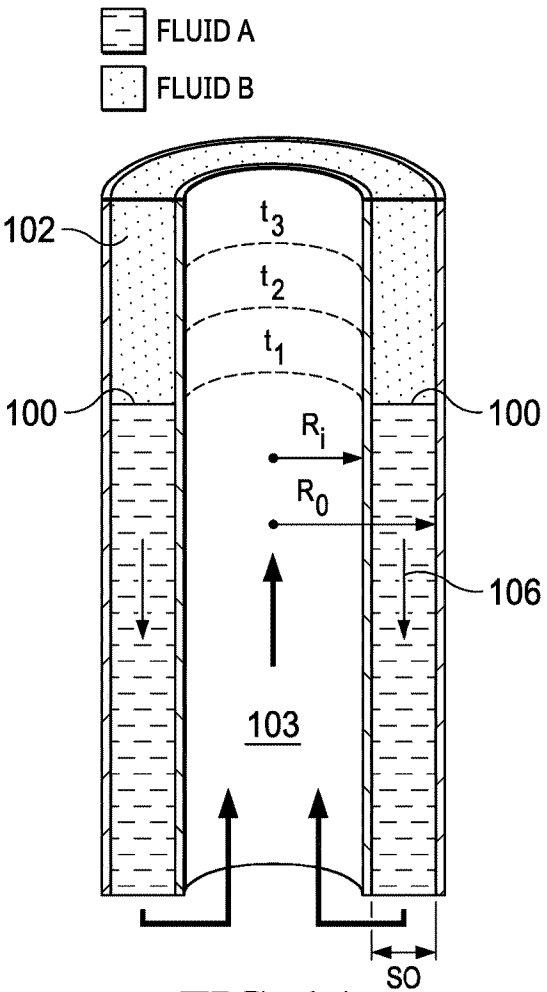

FIGS. 1A-1C illustrate fluid interfaces in a downhole environment, in accordance with examples of the present disclosure. FIG. 1A illustrates a fluid interface 100 in a concentric annulus 102 with a downhole tubular 103, such as casing for example. Fluid B may be disposed/pumped in the annulus 102 to displace fluid A, as indicated by the directional arrows 106. The fluid interface 100 is an ideal flat interface without fluid channeling. The fluid interface 100 in the concentric annulus 102 may be flat or substantially flat because the mean-velocity of the total fluid is the same throughout the annulus 102. Total fluid level within the tubular 103 is indicated at times $t_1$, $t_2$, and $t_3$. $R_i$ is the inner radii of the annulus 102 and $R_o$ is the outer radii of the annulus 102. Stand-off (SO) may be a distance between an external surface of a tubular such as, for example, casing, and the borehole wall.

FIG. 1B illustrates the fluid interface 100 in an eccentric annulus 108 with the downhole tubular 103. Due to the eccentric annulus 108, fluid channeling at the interface 100 occurs as the Fluid B travels further on the wider side 110 of the annulus 108 compared to the narrower side 112. As shown, stretching (e.g., channeling) of the fluid interface 100 occurs in the eccentric annulus 108, as the total fluid on the narrower side 112 of the annulus 108 moves very slowly compared to the total fluid on the wider side 110. Total fluid level within the tubular 103 is indicated at times $t_1$, $t_2$, and $t_3$.

FIG. 1C illustrates the eccentric annulus 108, with reduced fluid channeling at the interface 100, compared to FIG. 1B, achieved via the design of the properties of fluid B, using techniques as described herein. As shown, displacement efficiency of the fluid A using the designed fluid B is increased/optimized. Total fluid level within the tubular 103 is indicated at times $t_1$, $t_2$, and $t_3$.

In particular examples, a two-fluid system may be utilized in a downhole environment. The efficiency of the fluid(s) displacement may be directly related to the "flatness" of the fluid interface between the fluids. The parameters that may influence the interface mechanics may comprise at least the density difference of the fluids; friction pressure gradients of the fluids; geometry, including the standoff.

The following exemplary equations; Table 1; and/or stability maps (e.g., FIGS. 4B-4D) may serve as a basis for Fluid Design Models to optimize displacement efficiency and/or assess fluid system stability. The relationship of the fluid displacement may be represented with the following exemplary equation:

$$\text{Displacement Efficiency} = f(B, M, SO) \qquad \text{Equation 1}$$

$$\text{where } B = \frac{\text{difference in density or hydrostatic gradient of fluids}}{\text{friction gradient of the second fluid}}; \text{ and}$$

$$M = \frac{\text{friction gradient of second fluid}}{\text{friction gradient of first fluid}};$$

$$SO = \text{Stand-off.}$$

In a top-heavy configuration, for a given density difference, optimal fluid placement may be achieved when the second fluid (e.g., top fluid) is designed such that the friction pressure gradient is close to or more than that of the density gradient difference while maintaining rheological hierarchy.

It should be noted that Eq. 1 is an example and that other variations of Eq. 1 may be used. For example, a friction gradient may be calculated via correlations. Also, (average μ)U/k, from Eq. 2, can be used instead of the friction gradient to calculate B and M.

The above equation may be used to design a method where the rheology of the second fluid may be optimized in a "top heavy" configuration to achieve a desired displacement. Further, the method may also be used to recommend an allowable density difference in a "top heavy" configuration where there are limitations on the rheology of fluids imposed by mixing or pumping equipment. Both scenarios may account for standoff in a subterranean well. Stand-off may be a distance between an external surface of a tubular such as, for example, casing, and the borehole wall.

In some examples, input parameters such as wellbore geometry, standoff, a first fluid density ($\rho_1$), rheology, and/or fluid flow rate may be received by, for example, a computer including fluid modeling software. Then, a determination of whether a second fluid is density ($\rho_2$) constrained. Density constrained means that the density of fluid B is known before-hand, and cannot be altered, hence constrained.

If $\rho_2$ is constrained, then a known target density of the second fluid may be used to estimate B from Equation 1 to determine a required displacement efficiency using a fluid design model (e.g., software). For example, the friction correlations (e.g., acquired from software/database) may be used to estimate a rheology needed to achieve B.

If $\rho_2$ is not constrained, then a known target rheology of the second fluid may be used to estimate B from Equation 1 to determine the required displacement efficiency using the fluid design model (e.g., software). For example, the friction correlations may be used to estimate friction gradients of both fluids to estimate density of the second fluid. Based on FIG. 2, suitable fluids may be designed, for use in a downhole environment such as during cementing operations, for example.

Figure 2:
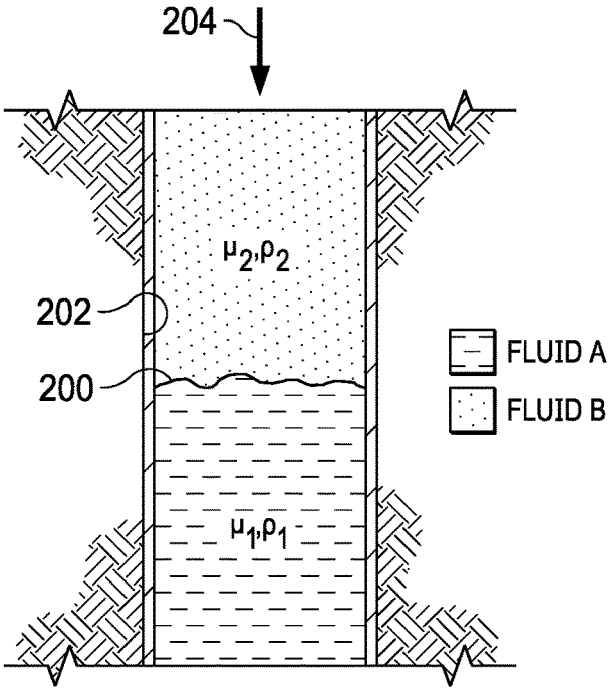
FIG. 2 illustrates a fluid interface between two fluids during displacement of a fluid, in accordance with examples of the present disclosure.

FIG. 2 illustrates a fluid interface between two fluids during displacement of a fluid, in accordance with examples of the present disclosure. A fluid interface 200 may be disposed between a first fluid A and a second fluid B. Each fluid having a different viscosity ($\mu_1$, $\mu_2$) and density ($\rho_1$, $\rho_2$). At least the fluid B may be pumped into a wellbore 202 indicated by directional arrows 204. In some examples, the fluids may include, drilling fluid, cement, spacer fluids, and/or water. The fluid B may displace the fluid A.

Fluid displacement efficiency ("DE") may be described in mathematical terms:

$$\frac{dP}{dx} = -\frac{\mu U}{k} + \rho g \qquad \text{Equation 2}$$

where P=fluid pressure;
U=velocity of flow;
$\mu$=viscosity of fluid;
k=geometry factor; and
g=gravitational constant.

Integrating Equation 2 over an interface expands the equation to:

$$P_2 - P_1 = \left[(\mu_1 - \mu_2)\frac{U}{k} + (\rho_2 - \rho_1)g\right]\delta x \qquad \text{Equation 3}$$

where $\delta x$ is the distance between point 1 for $P_1$ and point 2 for $P_2$, and Equation 3 may represent stable conditions. Conversely, when $P_2 < P_1$ the system may be unstable and viscous fingering may occur.

Table 1 indicates conditions of viscosity and density that result in stable and unstable fluid conditions for reverse circulation. The "thinner fluid" may be a drilling mud and the "thicker fluid" may be a spacer fluid or cement. It should be noted that Table 1 does not account for eccentricity in the annulus. These rules are applicable for a unidimensional geometry such as, for example, a concentric interface, inside of a pipe.

TABLE 1

Conditions of viscosity and density for stable and unstable fluid conditions in an annulus for reverse cementing/circulation.

| Conditions on Viscosity and Density | Remarks | Stable or Unstable |
|---|---|---|
| $\mu_1 < \mu_2$<br>$\rho_1 > \rho_2$ | The top fluid (pushing fluid) is thicker and less dense than the bottom fluid | Stable |
| $\mu_1 < \mu_2$<br>$\rho_1 > \rho_2$ | Top fluid is thinner and denser than the bottom fluid | Unstable when $U < U_c$, where $U_c = \left(\frac{\rho_1 - \rho_2}{\mu_1 - \mu_2}\right)gk$ (Equation 4) |
| $\mu_1 < \mu_2$<br>$\rho_1 > \rho_2$ | Top fluid is thinner and denser. | Unstable |
| $\mu_1 < \mu_2$<br>$\rho_1 > \rho_2$ | Top fluid is thinner and less dense | Unstable when $U < U_c$, where $U_c = \left(\frac{\rho_1 - \rho_2}{\mu_1 - \mu_2}\right)gk$ |

The displacement efficiency may be defined to quantify the displacing fluid and/or the displaced fluid. In some non-limiting examples, the displacement efficiency may be defined as Volumetric Displacement Efficiency ($\eta_v$), which is the measure of the extent to which the displaced fluid is replaced by the displacing fluid. It is defined by Equation 5.

$$\eta_v = \frac{\text{Volume of displacing fluid in annulus}}{\text{volume of annulus}} = \frac{\sum(c \cdot v_i)}{V_{annulus}}, \qquad \text{Equation 5}$$

where c is the concentration of the displacing fluid in the computational cells; vi is the volume of the corresponding cell, which is summed up over all the cells in the domain.

In other non-limiting examples, the displacement efficiency may be defined as Cross-sectional Displacement Efficiency ($\eta_{cs}$), which quantifies the amount of displacing fluid (fluid B) at a given depth in the annulus. It is defined by Equation 6.

Equation 6

$$\eta_{cs\ @\ depth\ of\ interest} = \frac{\text{Area occupied by displacing fluid}}{\text{Total area of annular cross section}} = \frac{\sum(c \cdot a_i)}{\text{Area}_{cross\ section}}$$

Figure 3:
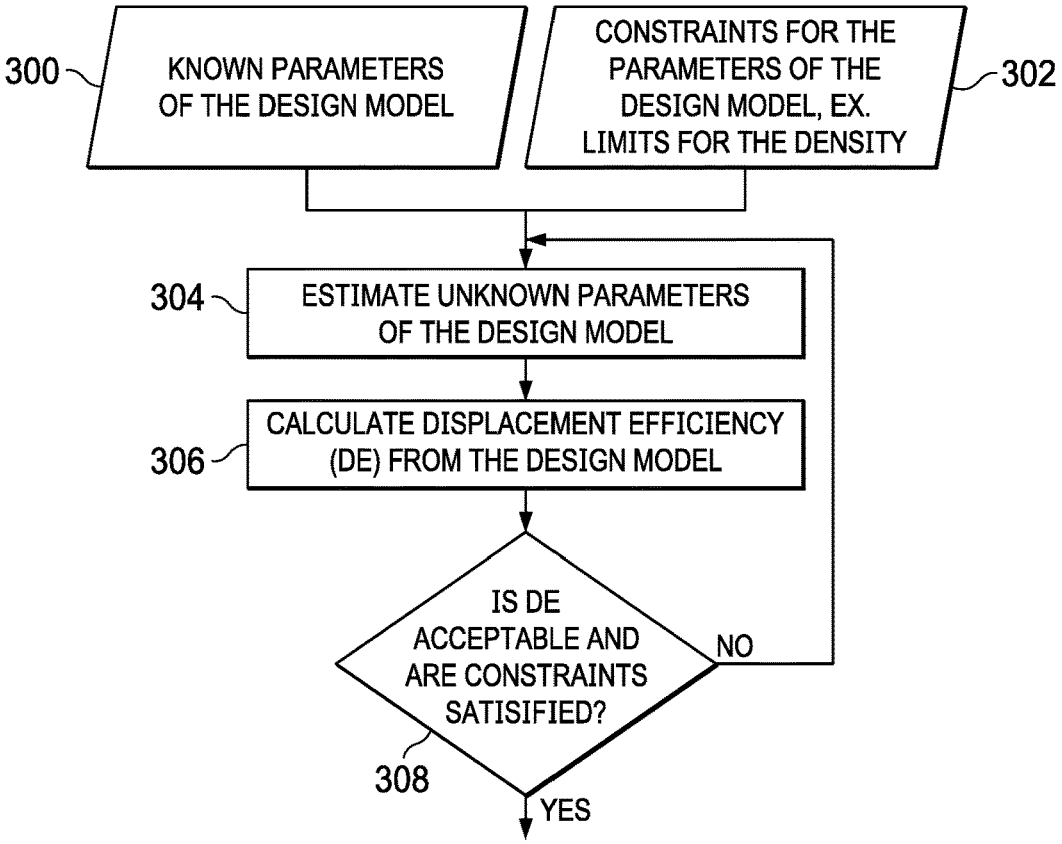
FIG. 3 illustrates an operative flow chart for designing fluids that reduce channeling at an interface, in accordance with examples of the present disclosure.

FIG. 3 illustrates an operative flow chart for designing fluids that reduce channeling at an interface, in accordance with examples of the present disclosure. This flow may assess displacement efficiency as a function of at least one of the following parameters: $\rho_1$, $\rho_2$, a first rheology, a second rheology, SO, flow rate, and/or flow direction.

At step 300, at least one known input parameter for the Design Model such as standoff, fluid A density ($\rho_1$), rheology, fluid flow rate, and/or flow direction may be received by, for example, a computer including fluid modeling software. At step 302, at least one constraint for the parameters (e.g., density limit) of the Design Model is received by the computer. At step 304, the computer may estimate unknown parameters based on the constraints and the known parameters. At step 306, the computer may calculate the displacement efficiency (DE). At step 308, the computer determines whether the DE is acceptable, and that the constraints are satisfied (e.g., thresholds are met for the design). If not satisfied, the workflow proceeds to repeat steps 304-308 until an acceptable design is created. Steps 304-306 may be performed on the computer via solution schemes for non-linear equations. For example, estimation may be performed randomly; via schemes updated with specific parameters such as for example gradient descent; and/or via linearized versions of the constraints and/or the DE equation.

Figure 4A:
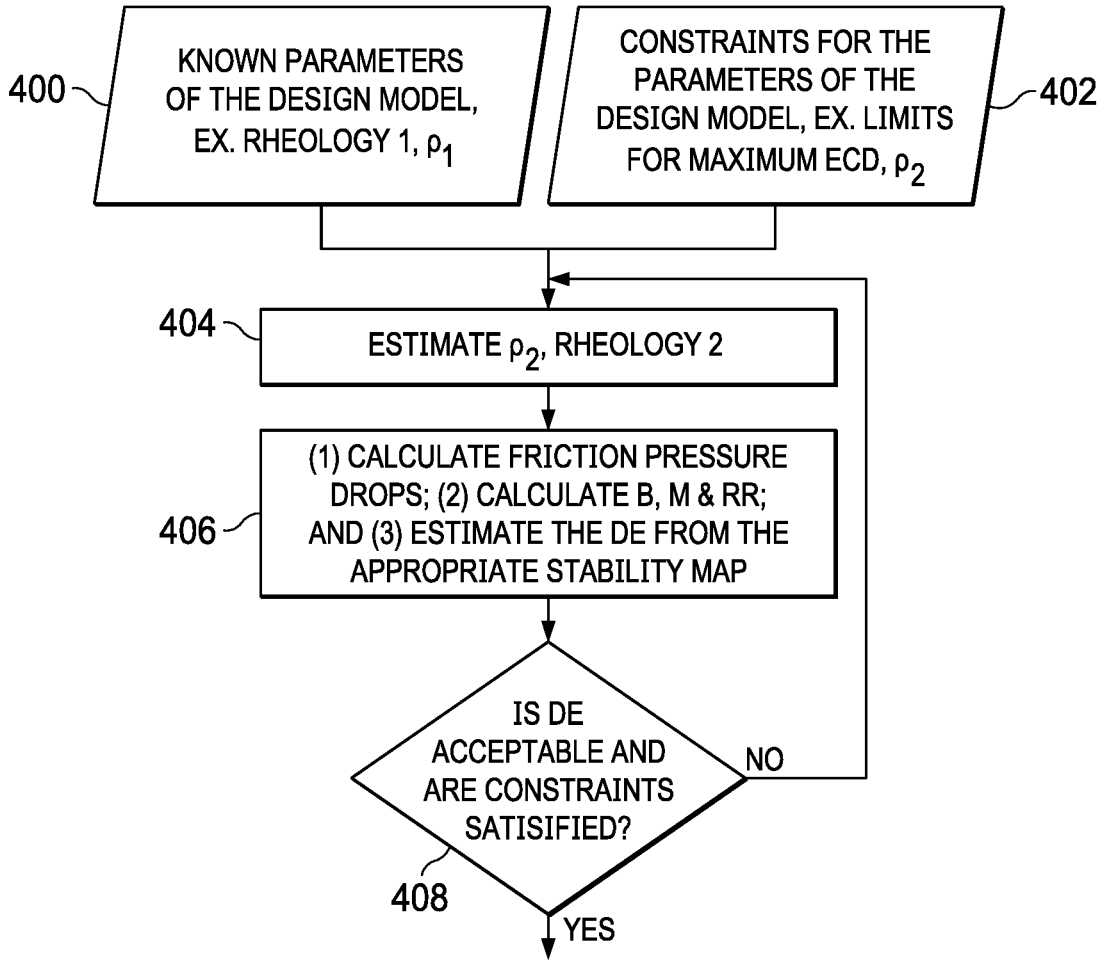
FIG. 4A illustrates an alternate operative flow chart for designing fluids that reduce channeling at an interface, in accordance with examples of the present disclosure.

FIG. 4A illustrates an alternate operative flow chart for designing fluids that reduce channeling at an interface, in accordance with examples of the present disclosure. This workflow may assess displacement efficiency as a function of B, M, SO, RR. RR is the radius ratio of the wellbore, defined by $RR=R_i/R_o$, ratio of inner to outer radii of the annulus. B and M are each a function of $\rho_1$, $\rho_2$, a first rheology, a second rheology, SO, flow rate, and/or wellbore geometry.

At step 400, at least one known input parameter for the Design Model such as a first rheology, fluid A density ($\rho_1$), may be received by, for example, a computer including fluid modeling software. At step 402, at least one constraint for the parameters of the Design Model (e.g., $\rho_2$ and maximum equivalent circulating density (ECD)) of the Design Model is received by the computer. At step 404, the computer may estimate via software, the $\rho_2$ and the second rheology. At step, 406, the computer (e.g., via fluid modeling software) may perform the following: (1) calculate friction pressure drops; (2) calculate B, M, and RR; and (3) estimate the DE from the appropriate stability map (see FIGS. 4B-4C). At step 408, the computer determines whether the DE is acceptable, and that the constraints are satisfied (e.g., thresholds are met for the design). If not satisfied, the workflow proceeds to repeat steps 404-408 until an acceptable/desired design is created.

Figure 4B:
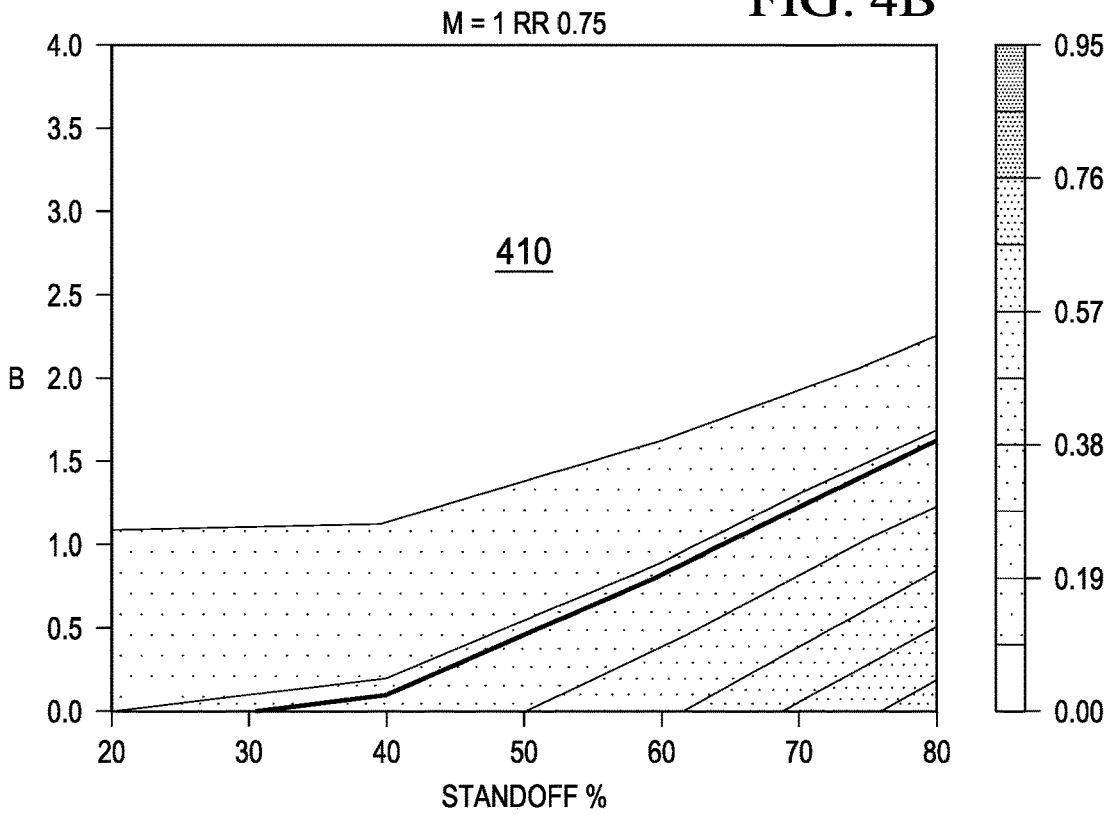
FIGS. 4B-4D illustrate stability maps for use with the workflow of FIG. 4A, in accordance with examples of the present disclosure.
Figure 4C:
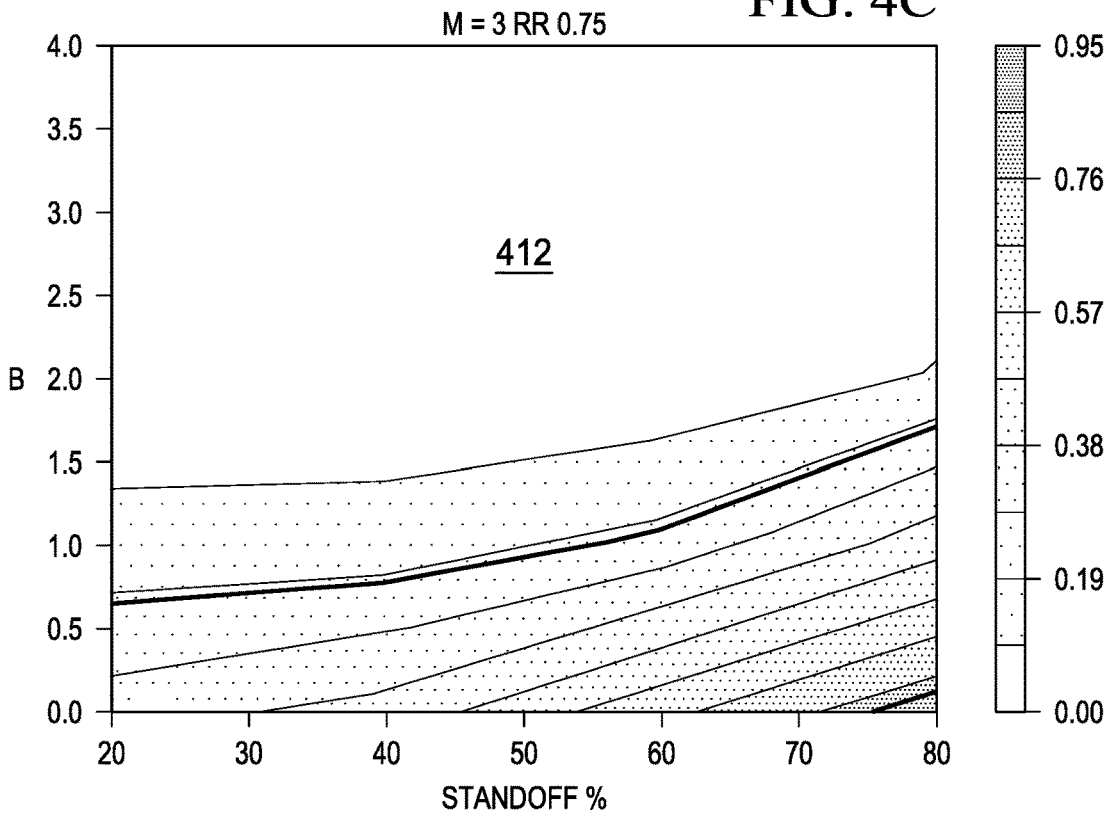
Figure 4D:
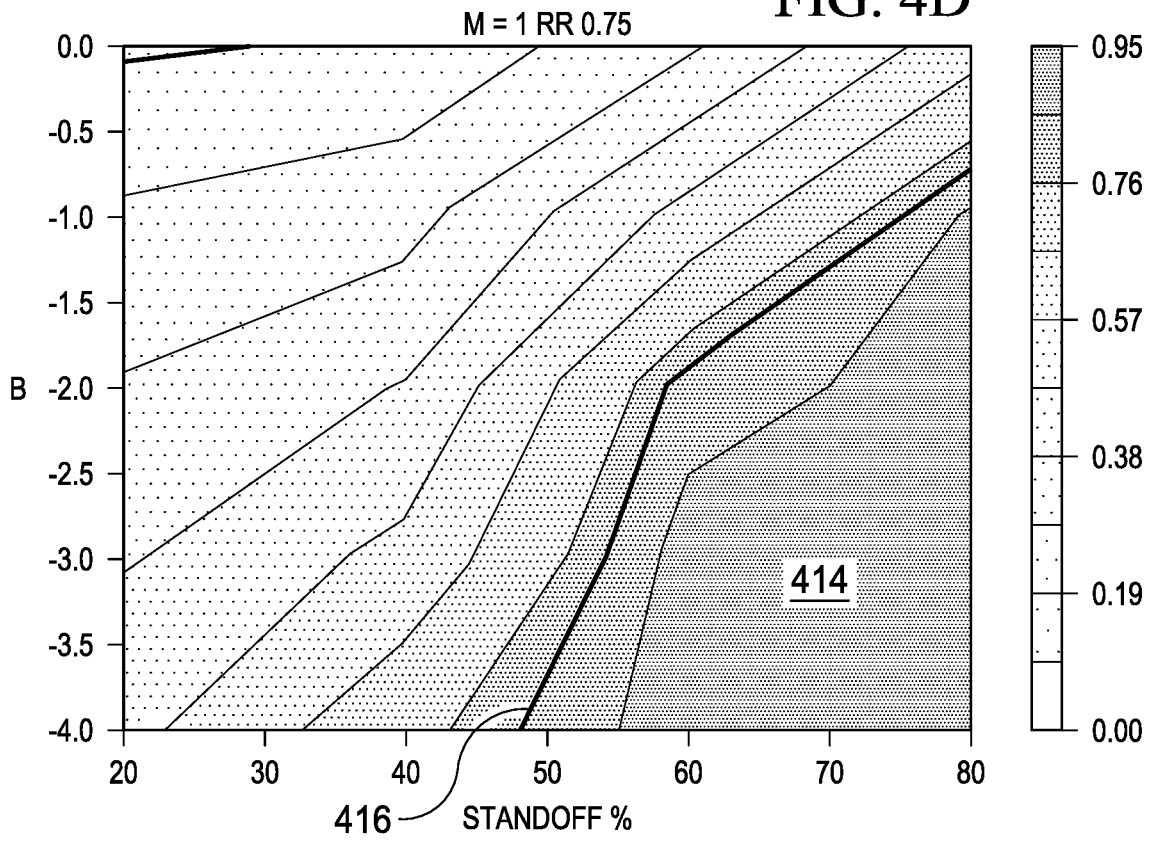

FIGS. 4B-4D illustrate stability maps for use with the workflow of FIG. 4A, in accordance with examples of the present disclosure. The stability maps are results of multiple 3D simulations for 2-fluid displacement in an eccentric annulus, at each operating point on the map. The results of the simulations show channeling at interface.

Severe channeling at interface is indicated in regions 410 and 412 as shown on FIGS. 4B and 4C. Low channeling for values of B versus the stand-off is shown in region 414 on FIG. 4D. These maps act as a reference for the user/engineer, while following the workflow in FIG. 4A, to select the value of B, based on the stand-off. The user/engineer may select B such that it is as close as possible to the region 414, marked by the line 416. The region 414 ability map is affected by the M, which is seen to increase with increasing M in FIGS. 4C and 4D. The region 414 is also affected by RR, and the user should choose an appropriate stability map based on the fluids at hand.

Figure 5:
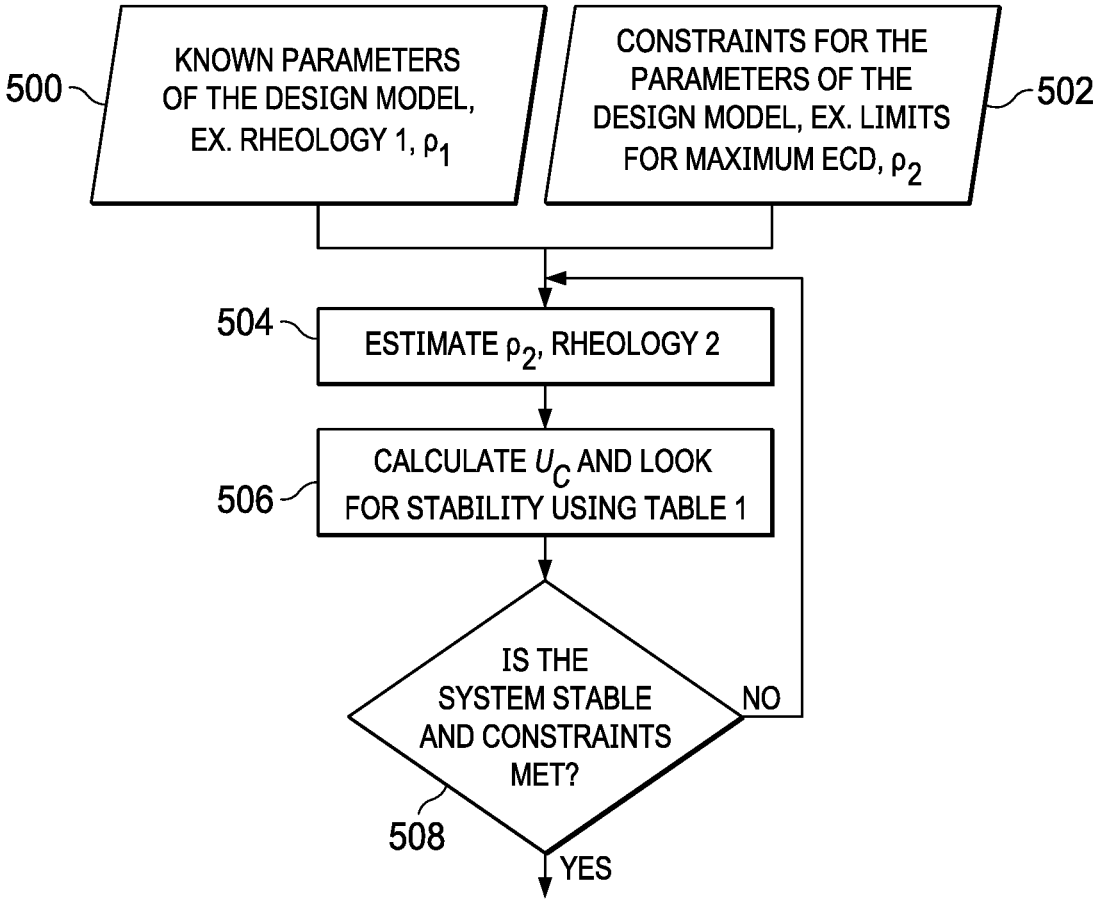
FIG. 5 illustrates another operative flow chart for designing fluids that reduce channeling at an interface, in accordance with examples of the present disclosure.

FIG. 5 illustrates another alternate operative flow chart for designing fluids that reduce channeling at an interface, in accordance with examples of the present disclosure. This workflow may assess the DE as a function of at least $\rho_1$, $\rho_2$, $\mu_1$, $\mu_2$, average fluid velocity (U), geometry factor k, or reverse flow or not. DE may describe the stability of the fluid system and is binary (True or False), based on Table 1.

At step 500, at least one known input parameter such as a first rheology and a fluid A density ($\rho_1$) may be received by, for example, a computer including fluid modeling software. At step 502, at least one constraint for the parameters of the Design Model (e.g., $\rho_2$ and maximum ECD) is received by the computer. At step 504, the computer may estimate via software, the $\rho_2$ and the second rheology. At step, 506, the computer may perform the following: calculate $U_c$ and look for system stability with Table 1. At step 508, the computer determines whether the system is stable, and that the constraints are satisfied (e.g., thresholds are met for the design). If not satisfied, the workflow proceeds to repeat steps 504-508 until an acceptable/desired design is created.

Figure 6:
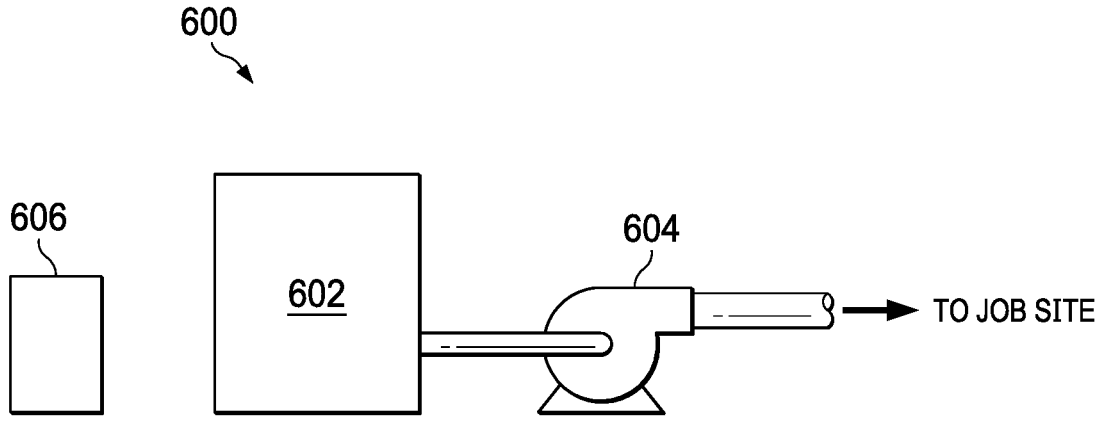
FIG. 6 illustrates a system for the preparation of a designed fluid and subsequent delivery of the designed fluid to an application site, in accordance with examples of the present disclosure.

FIG. 6 illustrates a system 600 for the preparation of a designed fluid(s) and subsequent delivery of the designed fluid to an application site, in accordance with examples of the present disclosure. As shown, the designed fluid(s) may be mixed and/or stored in a vessel 602. Vessel 602 may be any such vessel suitable for containing and/or mixing the designed fluids, including, but not limited to drums, barrels, tubs, bins, jet mixers, re-circulating mixers, and/or batch mixers. The designed fluids may then be pumped via pumping equipment 604.

The system 600 may also include a computer 606 for calculating the required displacement efficiency as well as utilize the fluid design model to prepare the designed fluids. The computer 606 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. The computer 606 may be any processor-driven device, such as, but not limited to, a personal computer, laptop computer, smartphone, tablet, handheld computer, dedicated processing device, and/or an array of computing devices. In addition to having a processor, the computer 606 may include a server, a memory, input/output ("I/O") interface(s), and a network interface. The memory may be any computer-readable medium, coupled to the processor, such as RAM, ROM, and/or a removable storage device for storing data and a database management system ("DBMS") to facilitate management of data stored in memory and/or stored in separate databases. The computer 606 may also include display devices such as a monitor featuring an operating system, media browser, and the ability to run one or more software applications. Additionally, the computer 606 may include non-transitory computer-readable media. Non-transitory computer-readable media may include any instrumentality or aggregation of instrumentalities that may retain data and/or instructions for a period of time.

Figure 7:
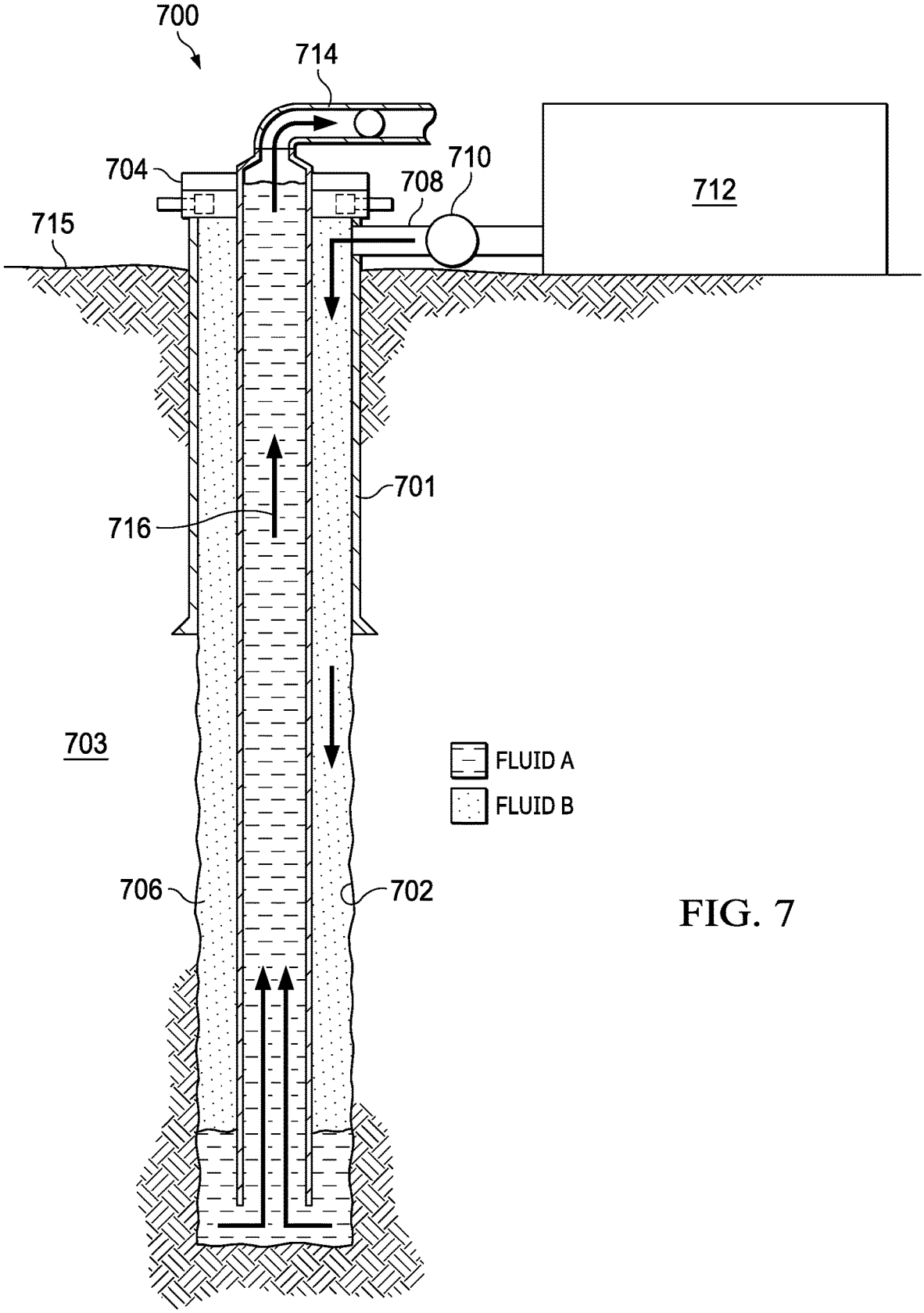
FIG. 7 illustrates a system for reverse circulation of the fluids designed based on displacement efficiency, in accordance with examples of the present disclosure.

FIG. 7 illustrates a system 700 for reverse circulation of the fluids designed based on displacement efficiency, in accordance with examples of the present disclosure. Although a land-based operation is illustrated, examples of the present disclosure are also applicable to offshore operations. It should be noted that the techniques as described herein are applicable to forward cementing operations and reverse cementing operations.

Casing 701 may be installed in a wellbore 702 in a subterranean formation 703. A wellhead 704 may be attached to the top of the casing 701. An annulus 706 is defined between the wellbore 702 and the casing 701. A conduit 708 (e.g., feed line) may be connected to the casing 701 to fluidly communicate with the annulus 706. The conduit 708 may be in fluid communication with a pump 710. The conduit 708 may be connected to a source 712 (e.g., a container) to provide the designed fluid(s).

A return line 714 may be connected to the wellhead 704 to fluidly communicate with the casing 701. The designed fluids A and/or B may enter the annulus 706 directly from the conduit 708 to reverse circulate the designed fluid A and/or the designed fluid B. Fluid B may displace fluid A to the surface 715 via the return line 714 indicated by directional arrows 716.

Accordingly, the present disclosure may relate to techniques for designing optimized fluids for downhole fluid displacement applications such as during cementing, for example. The systems and methods may include any of the various features disclosed herein, including one or more of the following statements.

Statement 1. A method comprising receiving at least one known parameter for a fluid design; receiving at least one constraint for the fluid design; estimating at least one unknown parameter for the fluid design; calculating displacement efficiency of the fluid design based on the at least one known parameter and at least one estimated parameter; and producing a designed fluid based on the displacement efficiency.

Statement 2. The method of the statement 1, further comprising determining that the displacement efficiency satisfies a threshold.

Statement 3. The method of any of the preceding statements, further comprising determining that the at least one constraint is satisfied.

Statement 4. The method of any of the preceding statements, further comprising pumping the designed fluid downhole to contact a second fluid.

Statement 5. The method of any of the preceding statements, wherein the receiving known parameters comprises receiving a density for the fluid design.

Statement 6. The method of any of the preceding statements, wherein the receiving known parameters comprises receiving a density of a second fluid for the fluid design.

Statement 7. The method of any of the preceding statements, further comprising displacing a second fluid with the designed fluid.

Statement 8. The method of any of the preceding statements, further comprising reducing channeling at an interface between both fluids.

Statement 9. The method of any of the preceding statements, further comprising displacing a second fluid during a cementing operation.

Statement 10. The method of any of the preceding statements, further comprising displacing a second fluid during a reverse circulation operation.

Statement 11. A method comprising: receiving at least one known parameter for a fluid design; receiving at least one constraint for the fluid design; estimating at least one unknown parameter for the fluid design; estimating displacement efficiency of the fluid design based on a fluid stability map; and producing a designed fluid based on the displacement efficiency.

Statement 12. The method of any of the statement 11, further comprising determining that the displacement efficiency satisfies a threshold.

Statement 13. The method of the statement 11 or the statement 12, further comprising determining that the at least one constraint is satisfied.

Statement 14. The method of any of the statements 11-13, further comprising displacing a second fluid with the designed fluid.

Statement 15. The method of any of the statements 11-14, further comprising reducing channeling at the interface between both fluids.

Statement 16. A method comprising: receiving at least one known parameter for a fluid design; receiving at least one constraint for the fluid design; estimating at least one unknown parameter for the fluid design; calculating fluid stability for the fluid design; and producing a designed fluid based on the fluid stability.

Statement 17. The method of any of the statement 16, further comprising determining that the fluid stability satisfies a threshold.

Statement 18. The method of any of the statements 16 or 17, further comprising determining that the at least one constraint is satisfied.

Statement 19. The method of any of the statements 16-18, further comprising displacing a second fluid with the designed fluid.

Statement 20. The method of any of the statements 16-19, further comprising reducing channeling at the interface between both fluids.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method for designing a wellbore fluid with reduced channeling at a fluid interface between a designed fluid and a second fluid in a wellbore comprising:

receiving at least one known parameter for a fluid design, wherein the at last one know parameter is selected from the group consisting of density of the second fluid, rheology of the second fluid, flow rate of the designed fluid, eccentricity, wellbore geometry, standoff, and combinations thereof;

receiving at least one constraint for the fluid design wherein the at least one constraint is selected from the group consisting of density of the designed fluid, rheology of the designed fluid, flow rate of the designed fluid, and combinations thereof;

selecting a parameter B using a stability map and at the least one known parameter such that a displacement efficiency of displacing the second fluid with the designed fluid in the wellbore is above a threshold and estimating at least one unknown parameter for the fluid design using the stability map and parameter B, wherein the unknown parameter is selected from the group consisting of density of the designed fluid or rheology of the designed fluid;

preparing the designed fluid based on the at least one constraint and the unknown parameter;

pumping the designed fluid into a wellbore using a pump; and displacing the second fluid with the designed fluid wherein the designed fluid reduces channeling at an interface between the designed fluid and the second fluid.

2. The method of claim 1, further comprising determining that the displacement efficiency satisfies a threshold.

3. The method of claim 2, further comprising determining that the at least one constraint is satisfied.

4. The method of claim 1, further comprising pumping the designed fluid into the wellbore to contact the second fluid.

5. The method of claim 1, wherein the receiving known parameters comprises receiving a density for the fluid design.

6. The method of claim 1, wherein the receiving known parameters comprises receiving a density of a second fluid for the fluid design.

7. The method of claim 1, further comprising displacing a second fluid during a cementing operation.

8. The method of claim 1, further comprising displacing a second fluid during a reverse circulation operation.

9. The method of claim 1 wherein the at least one known parameter comprises at least one parameter selected from the group consisting of eccentricity, fluid flow rate, fluid density (pi), fluid rheology, wellbore geometry, standoff, and combinations thereof.

10. The method of claim 1 further comprising using a friction correlation to determine the rheology of the designed fluid based on the parameter B.

11. The method of claim 1 further comprising using a friction correlation to determine the density of the designed fluid based on the parameter B.

12. A method for designing a wellbore fluid with reduced channeling at a fluid interface comprising:

receiving at least one known parameter for a fluid design;

receiving at least one constraint for the fluid design;

estimating at least one unknown parameter for the fluid design;

estimating a displacement efficiency of the fluid design based on a fluid stability map, wherein the stability map is a function of a radius ratio of the wellbore, B, and M where:

$$B = \frac{\text{difference in density or hydrostatic gradient of fluids}}{\text{friction gradient of the second fluid}}, \text{ and}$$

$$M = \frac{\text{friction gradient of second fluid}}{\text{friction gradient of first fluid}};$$

preparing a designed fluid based on the displacement efficiency;

pumping the designed fluid into a wellbore using a pump; and displacing a second fluid with the designed fluid wherein the designed fluid reduces channeling at an interface between the designed fluid and the second fluid.

13. The method of claim 12, further comprising determining that the displacement efficiency satisfies a threshold.

14. The method of claim 12, further comprising determining that the at least one constraint is satisfied.

15. The method of claim 12 wherein the at least one known parameter comprises at least one parameter selected from the group consisting of eccentricity, fluid flow rate, fluid density (pi), fluid rheology, wellbore geometry, standoff, and combinations thereof.

16. A method for designing a wellbore fluid with reduced channeling at a fluid interface comprising:

receiving at least one known parameter for a fluid design;

receiving at least one constraint for the fluid design;

estimating at least one unknown parameter for the fluid design;

calculating Uc and determining a fluid stability for the fluid design where $$U_c = \left(\frac{\rho_1 - \rho_2}{\mu_1 - \mu_2}\right) gk;$$

preparing a designed fluid based on the fluid stability;

pumping the designed fluid into a wellbore using a pump; and displacing a second fluid with the designed fluid wherein the designed fluid reduces channeling at an interface between the designed fluid and the second fluid.

17. The method of claim 16, further comprising determining that the fluid stability satisfies a threshold.

18. The method of claim 16, further comprising determining that the at least one constraint is satisfied.

19. The method of claim 16 wherein the at least one known parameter comprises at least one parameter selected from the group consisting of eccentricity, fluid flow rate, fluid density (pi), fluid rheology, wellbore geometry, standoff, and combinations thereof.

* * * * *